US008668097B2

(12) United States Patent
Jourdin et al.

(10) Patent No.: US 8,668,097 B2
(45) Date of Patent: Mar. 11, 2014

(54) COVER MEMBER FOR MOUNTING ON A FASTENER RING FOR A DISPENSER, METHOD OF PRODUCING ONE SUCH MEMBER AND FLUID PRODUCT DISPENSER USING ONE SUCH MEMBER

(75) Inventors: Gilles Jourdin, Combon (FR); Cèdric Mesnil, La Neuville du Bosc (FR)

(73) Assignee: Aptar France SAS, Le Neubourg (FR)

( * ) Notice: Subject to any disclaimer, the term of this patent is extended or adjusted under 35 U.S.C. 154(b) by 861 days.

(21) Appl. No.: 12/089,007

(22) PCT Filed: Oct. 2, 2006

(86) PCT No.: PCT/FR2006/050972

§ 371 (c)(1),
(2), (4) Date: Sep. 15, 2008

(87) PCT Pub. No.: WO2007/042704

PCT Pub. Date: Apr. 19, 2007

(65) Prior Publication Data

US 2010/0213159 A1 Aug. 26, 2010

(30) Foreign Application Priority Data

Oct. 4, 2005 (FR) ..... 05 10150

(51) Int. Cl.
*B65D 45/30* (2006.01)
*B65D 83/48* (2006.01)

(52) U.S. Cl.
USPC ..... 215/274; 215/317; 215/321; 220/319; 222/153.1

(58) Field of Classification Search
USPC ..... 215/273–277, 357, 316–354; 138/95 R–96 T; 220/915; 222/321.1–321.9; 16/108, 109
See application file for complete search history.

(56) References Cited

U.S. PATENT DOCUMENTS 613,371 A * 11/1898 Hoffman et al. ..... 215/332
649,453 A * 5/1900 Hoffman ..... 215/332

(Continued)

FOREIGN PATENT DOCUMENTS

DE 20 2004 000 921 U1 5/2005
EP 0 704 250 A2 4/1996

(Continued)

OTHER PUBLICATIONS

International Search Report for PCT/FR2006/050969, dated Feb. 22, 2007.

(Continued)

*Primary Examiner* — J. Gregory Pickett
*Assistant Examiner* — Ned A Walker
(74) *Attorney, Agent, or Firm* — Sughrue Mion, PLLC

(57) ABSTRACT

A covering member (1) for mounting on a fastener ring (2), the ring and the covering member co-operating with each other to form a fastener device for fastening a dispenser system (3) on a receptacle neck (40). The covering member is substantially cylindrical and includes an outside wall (14) and an inside wall (15) for coming into clamping contact around the ring (2). The inside wall forms at least one elongate groove (16) hollowed out in a base zone (151). The groove is formed by a plurality of groove segments (17) that are separated by non-groove zones in such a manner as to form a groove that is interrupted locally.

8 Claims, 5 Drawing Sheets

(56) References Cited

U.S. PATENT DOCUMENTS 651,369 A * 6/1900 Lindemeyr ..... 215/337
759,168 A * 5/1904 Fenn ..... 215/329
810,736 A * 1/1906 Fenn ..... 215/272
910,128 A * 1/1909 Hammer ..... 215/337
942,141 A * 12/1909 Hoffman ..... 215/332
1,116,241 A * 11/1914 Carlson ..... 411/437
1,353,399 A * 9/1920 Ingram et al. ..... 215/337
1,386,729 A * 8/1921 Ramsey ..... 215/317
1,386,742 A * 8/1921 Taliaferro ..... 215/274
1,427,683 A * 8/1922 Greenewald ..... 215/337
1,464,584 A * 8/1923 Ramsey ..... 215/307
1,590,517 A * 6/1926 Jacobs ..... 138/96 T
1,720,835 A * 7/1929 Holmdahl ..... 215/317
1,776,528 A * 9/1930 Unke ..... 138/96 T
RE18,184 E * 9/1931 Brown et al. ..... 138/96 T
1,853,946 A * 4/1932 Unke ..... 138/96 T
1,882,995 A * 10/1932 Scofield ..... 215/317
1,965,713 A * 7/1934 Shaw ..... 215/253
1,974,251 A * 9/1934 Reutter ..... 215/338
1,974,252 A * 9/1934 O'L Killorin ..... 215/338
2,125,790 A * 8/1938 Johnson ..... 215/20
2,223,202 A * 11/1940 Bergan ..... 411/428
2,251,897 A * 8/1941 Severn ..... 138/96 T
2,304,826 A * 12/1942 Jackson ..... 215/324
2,543,960 A * 3/1951 Elmer ..... 138/96 T
2,632,478 A * 3/1953 Ronfeldt ..... 138/96 T
2,726,001 A * 12/1955 Cululi ..... 215/327
2,853,047 A * 9/1958 Berisch et al. ..... 118/718
2,980,274 A * 4/1961 Gould ..... 215/220
2,990,079 A * 6/1961 Garvey ..... 215/260
3,069,040 A * 12/1962 Corsette ..... 215/318
3,343,252 A 9/1967 Reesor
3,503,534 A * 3/1970 Moller ..... 215/328
3,516,572 A * 6/1970 Davis Paul ..... 220/781
3,589,544 A * 6/1971 Hannon ..... 215/252
3,592,499 A * 7/1971 Nelson et al. ..... 292/347
3,631,650 A * 1/1972 Leftault, Jr. ..... 53/488
3,648,874 A * 3/1972 Moller ..... 215/252
3,682,345 A * 8/1972 Baugh ..... 215/330
3,690,495 A * 9/1972 Lloyd ..... 215/220
3,812,741 A * 5/1974 Heine ..... 81/3.4
3,854,371 A * 12/1974 Lamothe ..... 411/337
3,868,038 A * 2/1975 Hadley ..... 215/305
3,885,696 A * 5/1975 Eberhardt ..... 215/337
3,963,120 A * 6/1976 Perfect ..... 206/219
4,006,836 A * 2/1977 Micallef ..... 215/218
4,058,031 A * 11/1977 Magarian ..... 81/64
4,119,121 A * 10/1978 Smiley ..... 138/96 T
4,223,793 A * 9/1980 Patton ..... 215/220
4,241,864 A * 12/1980 Kessler ..... 229/5.5
4,366,921 A * 1/1983 Kirk, Jr. ..... 222/153.09
4,382,521 A * 5/1983 Ostrowsky ..... 215/307
4,399,092 A * 8/1983 Snow et al. ..... 264/318
4,427,126 A * 1/1984 Ostrowsky ..... 215/307
4,456,137 A * 6/1984 Lyman ..... 215/230
4,461,394 A * 7/1984 Sendel et al. ..... 215/330
4,485,934 A * 12/1984 Maguire ..... 215/252
4,500,006 A * 2/1985 Lafortune et al. ..... 215/224
4,501,301 A * 2/1985 Snow et al. ..... 138/96 T
4,509,654 A * 4/1985 Maguire ..... 215/253
4,553,567 A * 11/1985 Telander ..... 138/96 T
4,645,087 A * 2/1987 Kusz ..... 215/254
4,655,256 A * 4/1987 Lasota et al. ..... 138/96 T
4,669,620 A * 6/1987 Coifman ..... 215/220
4,704,924 A * 11/1987 Echols ..... 81/3.4
4,709,825 A * 12/1987 Mumford ..... 215/318
4,717,034 A * 1/1988 Mumford ..... 215/318
4,721,220 A * 1/1988 Northup ..... 215/307
4,738,370 A * 4/1988 Urmston et al. ..... 215/307
4,747,502 A * 5/1988 Luenser ..... 215/307
4,773,553 A * 9/1988 Van Brocklin ..... 215/272
4,828,130 A * 5/1989 Hofmann ..... 215/317
4,997,097 A * 3/1991 Krautkramer ..... 215/307
5,004,112 A * 4/1991 McBride ..... 215/252
5,044,521 A * 9/1991 Peckels ..... 222/23
5,158,180 A * 10/1992 Zucker ..... 206/409
5,176,269 A 1/1993 Herman
5,192,006 A * 3/1993 Van Brocklin et al. .... 222/321.9
5,195,562 A * 3/1993 Dreyfuss et al. ..... 138/96 T
5,197,620 A * 3/1993 Gregory ..... 215/307
5,244,015 A * 9/1993 Dreyfuss et al. ..... 138/96 T
5,314,084 A * 5/1994 Folta et al. ..... 215/249
5,356,021 A * 10/1994 McBride et al. ..... 215/349
5,398,830 A * 3/1995 de Pous et al. ..... 215/324
5,562,219 A * 10/1996 de Pous et al. ..... 215/274
5,673,809 A * 10/1997 Ohmi et al. ..... 215/252
5,676,269 A * 10/1997 Blake et al. ..... 215/252
5,678,720 A * 10/1997 Van Melle ..... 220/287
5,704,400 A * 1/1998 Eldridge ..... 138/96 T
5,762,217 A * 6/1998 Ohmi et al. ..... 215/253
5,775,528 A * 7/1998 Wohlgemuth et al. ..... 215/256
5,791,504 A * 8/1998 Hofmann et al. ..... 215/223
5,799,810 A * 9/1998 de Pous et al. ..... 215/274
5,819,805 A * 10/1998 Mosing et al. ..... 138/96 T
5,836,468 A * 11/1998 Bosl et al. ..... 215/253
5,853,093 A * 12/1998 Neiger ..... 215/237
5,927,529 A * 7/1999 Hofmann et al. ..... 215/223
5,957,315 A * 9/1999 Kaitsuka ..... 215/252
5,960,972 A * 10/1999 Larguia, Sr. ..... 215/274
5,975,369 A * 11/1999 Yurkewicz et al. ..... 222/153.06
6,006,930 A * 12/1999 Dreyer et al. ..... 215/44
6,056,136 A * 5/2000 Taber et al. ..... 215/252
6,089,390 A 7/2000 Druitt et al.
6,109,466 A * 8/2000 Carrier ..... 215/330
6,116,443 A * 9/2000 Parrinello ..... 215/252
6,116,448 A * 9/2000 Fragos ..... 220/8
6,123,212 A * 9/2000 Russell et al. ..... 215/330
6,186,359 B1 * 2/2001 de Pous et al. ..... 222/1
6,253,941 B1 * 7/2001 VanBrocklin et al. ..... 215/274
6,276,544 B1 8/2001 Battegazzore
6,290,103 B1 9/2001 Fraillon
6,321,924 B1 * 11/2001 Yurkewicz et al. ..... 215/251
6,409,049 B1 * 6/2002 de Pous et al. ..... 222/153.09
6,491,175 B1 * 12/2002 Taha ..... 215/252
6,527,132 B1 * 3/2003 Druitt et al. ..... 215/341
6,543,648 B2 * 4/2003 de Pous et al. ..... 222/153.09
6,571,991 B2 * 6/2003 Jourdin ..... 222/321.9
6,581,792 B1 * 6/2003 Limanjaya ..... 215/252
6,588,614 B2 7/2003 Neuner
6,626,310 B2 * 9/2003 Taha ..... 215/252
6,640,988 B2 * 11/2003 Taha ..... 215/252
6,659,297 B2 * 12/2003 Gregory et al. ..... 215/252
6,695,171 B2 * 2/2004 Walters et al. ..... 222/153.13
6,758,359 B2 * 7/2004 Yurkewicz et al. ..... 215/251
6,772,893 B2 8/2004 Parés Montaner et al.
6,776,311 B2 * 8/2004 Ackermann ..... 222/321.7
6,929,137 B1 * 8/2005 Granger et al. ..... 215/252
6,935,540 B2 * 8/2005 Ackermann ..... 222/321.7
6,991,123 B2 * 1/2006 Druitt et al. ..... 215/341
7,011,236 B2 * 3/2006 VanBrocklin ..... 222/321.9
7,048,140 B1 * 5/2006 Caldwell ..... 220/371
7,111,746 B2 * 9/2006 Miceli et al. ..... 215/219
7,198,757 B2 * 4/2007 Chiarin ..... 422/568
7,207,452 B2 * 4/2007 Jourdin ..... 215/274
7,235,207 B2 * 6/2007 Gregory et al. ..... 264/320
7,431,877 B2 * 10/2008 Druitt ..... 264/328.1
7,451,899 B2 * 11/2008 de Pous ..... 222/321.9
7,645,414 B2 * 1/2010 Gregory et al. ..... 264/320
7,703,617 B1 * 4/2010 Branson et al. ..... 215/332
7,757,902 B2 * 7/2010 Bevans et al. ..... 222/321.9
7,780,043 B2 * 8/2010 Jourdin et al. ..... 222/321.9
8,051,879 B2 * 11/2011 Zeyfang ..... 138/96 T
2002/0000420 A1 * 1/2002 Taha ..... 215/252
2002/0047026 A1 * 4/2002 Jourdin ..... 222/321.9
2002/0100742 A1 * 8/2002 Jourdin ..... 215/274
2002/0125270 A1 * 9/2002 de Pous et al. ..... 222/153.09
2003/0098285 A1 * 5/2003 Gregory et al. ..... 215/252
2003/0116523 A1 * 6/2003 Druitt et al. ..... 215/341
2003/0231988 A1 * 12/2003 Chiarin ..... 422/99
2004/0099693 A1 * 5/2004 Ackermann ..... 222/321.7
2004/0124169 A1 * 7/2004 Gregory et al. ..... 215/200
2004/0195197 A1 * 10/2004 Miceli et al. ..... 215/219
2004/0222242 A1 * 11/2004 Ackermann ..... 222/321.2
2006/0070972 A1 * 4/2006 Gomer ..... 215/254

(56) References Cited

U.S. PATENT DOCUMENTS

| | | | | |
|---|---|---|---|---|
| 2006/0273115 | A1* | 12/2006 | De Pous | 222/321.9 |
| 2006/0283830 | A1* | 12/2006 | Jourdin et al. | 215/273 |
| 2007/0068972 | A1 | 3/2007 | Pleyer | |
| 2007/0181525 | A1* | 8/2007 | Gregory et al. | 215/252 |
| 2008/0053948 | A1 | 3/2008 | Bevans et al. | |
| 2008/0296309 | A1* | 12/2008 | Jourdin et al. | 220/694 |
| 2009/0224005 | A1* | 9/2009 | Jourdin et al. | 222/321.9 |
| 2010/0326560 | A1* | 12/2010 | Zeyfang | 138/96 T |

FOREIGN PATENT DOCUMENTS

| | | | |
|---|---|---|---|
| EP | 0 704 251 | A2 | 4/1996 |
| EP | 0 988 237 | A1 | 12/1998 |
| EP | 1 270 434 | A1 | 1/2003 |
| FR | 2040666 | A5 * | 1/1971 |
| WO | 98/55370 | A1 | 12/1998 |
| WO | 2007/042701 | A1 | 4/2007 |

OTHER PUBLICATIONS

European Search Report for EP 06 01 9267, dated Jan. 23, 2008.

U.S. Office Action for U.S. Appl. No. 11/523,834, dated Jan. 25, 2012.

U.S. Office Action for U.S. Appl. No. 12/089,079, dated Dec. 7, 2011.

* cited by examiner

COVER MEMBER FOR MOUNTING ON A FASTENER RING FOR A DISPENSER, METHOD OF PRODUCING ONE SUCH MEMBER AND FLUID PRODUCT DISPENSER USING ONE SUCH MEMBER

BACKGROUND OF THE INVENTION

The present invention relates to a covering member for mounting on a fastener ring, the ring and the covering member co-operating with each other to form a fastener device for fastening a dispenser system, such as a pump or a valve, on the neck of a receptacle. The present invention also relates to a method of manufacturing such a covering member. The present invention also relates to a fluid dispenser comprising a receptacle, a dispenser system (pump or valve), and a fastener device that integrates a covering member of the invention. Such fluid dispensers are frequently used in the fields of perfumery, cosmetics, or even pharmacy.

FIELD OF THE INVENTION

The covering member of the ring can have a plurality of technical and/or appearance functions. A first function of the covering member is technical and concerns retaining or blocking the fastener ring on the neck of the receptacle. The covering member can be used to prevent the ring from deforming outwards, and thus from becoming disengaged from the neck of the receptacle. Another function of the covering member concerns appearance and is to cover the fastener ring in such a manner as to impart thereto an attractive appearance. The covering member is thus made with materials and shapes that make it possible to impart thereto an attractive appearance. The covering member may be manufactured out of plastics material or out of metal.

DESCRIPTION OF THE RELATED ART

Regardless of whether the covering member fulfills an appearance or a technical function, it is important that it is retained in stationary manner on the fastener ring. It should not be possible to pull the covering member off the ring easily, merely by pulling on said covering member. It is therefore necessary for the fastening between the covering member and the ring to be able to withstand considerable traction. In order to improve the retention of the covering member on the ring, it is already known for the inside wall of the hoop that is to come into clamping contact with the ring to be made with projections that project inwards. In particular, this is the situation in documents EP-0 704 250 and U.S. Pat. No. 6,253,941.

In the above-mentioned European document, it is envisaged to form oblique portions in relief on the inside wall of the covering member. The oblique portions in relief make it possible to remove the covering member easily from the hoop for recycling purposes. In the above-mentioned American document, it is envisaged to form annular ribs or grooves on/in the inside wall of the covering member. The grooves or ribs impart good ability to withstand traction, but they are completely ineffective with regard to preventing the covering member from turning.

SUMMARY OF THE INVENTION

An object of the present invention is to remedy the above-mentioned drawbacks of the prior art by defining a covering member having considerable ability both to withstand traction and to prevent turning.

To achieve this object, the present invention proposes a covering member for mounting on a fastener ring, the ring and the covering member co-operating with each other to form a fastener device for fastening a dispenser system, such as a pump or a valve, on a receptacle neck, the covering member presenting a general configuration that is substantially cylindrical and that includes an outside wall and an inside wall for coming into clamping contact around the ring, the inside wall forming at least one elongate groove hollowed out in a base zone, the covering member being characterized in that the groove is formed by a plurality of groove segments that are separated by non-groove zones in such a manner as to form a groove that is interrupted locally.

In other words, the inside wall of the covering member is provided with groove segments that are disposed in one or more lines. It is possible to envisage forming a single groove only that extends along a geometrical path (helicoidal, sinusoidal, etc.), or along an irregular path. Naturally, for practical reasons, it is easier to form the grooves in the form of rectilinear lines that extend parallel to one another. By way of example, it is possible to dispose the grooves substantially vertically, i.e. parallel to the axis of the cylindrical covering member. In a variant, it is possible to dispose the grooves substantially horizontally in such a manner as to form annular grooves that are interrupted. It is also possible to form the grooves obliquely. The ends of the groove segments make it possible to improve the ability to withstand traction and/or turning. For grooves that are disposed vertically, the ends participate amply in withstanding traction. For horizontal annular grooves, the ends contribute greatly in preventing turning. For oblique grooves, the ends participate both in preventing turning and in withstanding traction. The ends participate in retention as a result of the plastics material constituting the fastener ring creeping into the segments, thereby forming corresponding blocking points that prevent removal by traction or turning. As a result, increasing the numbers of segments makes it possible to obtain considerable retention. In other words, the ends of the segments provide retention in the direction corresponding to the orientation of the grooves.

In an advantageous embodiment, the segments of a groove are elongate in the longitudinal direction of the groove, each segment forming two ends and two long edges, the adjacent ends of two segments being separated by the base zone. The long edges provide retention in a given direction, and the ends provide retention in the direction that is perpendicular thereto.

In another practical embodiment, the segments are made by displacing material, such that each segment is bordered by lumps of displaced material. The lumps of displaced material themselves constitute profiles forming projections or gaps that contribute still further in retaining the covering member on the fastener ring.

The present invention also defines a first method of manufacturing a covering member as defined above, the method comprising the following successive steps:

a) making a covering member by stamping metal; then b) machining the segments by removing material so as to form interrupted grooves. The only drawback with the technique of machining by removing material is that is generates metal debris or swarf that is difficult to remove completely. Consequently, the present invention proposes another manufacturing method in which the machining step is performed by displacing material and not by removing material. The technique of machining by displacing material has the advantage of not generating any metal debris or swarf. In this event, it is possible to perform the machining step by embossing or by knurling.

The invention also defines a fluid dispenser comprising a receptacle, a dispenser system, and a fastener device that integrates a covering member as defined above.

An advantageous principle of the invention consists in forming an array of discrete groove segments, the segments being separated by zones that are smooth or that are portions in relief that also participate, together with the segments, in retaining the covering member on the fastener ring.

The invention is described more fully below with reference to the drawings that show several embodiments of the invention by way of non-limiting example.

DETAILED DESCRIPTION OF THE EXEMPLARY EMBODIMENTS

Figure 1:
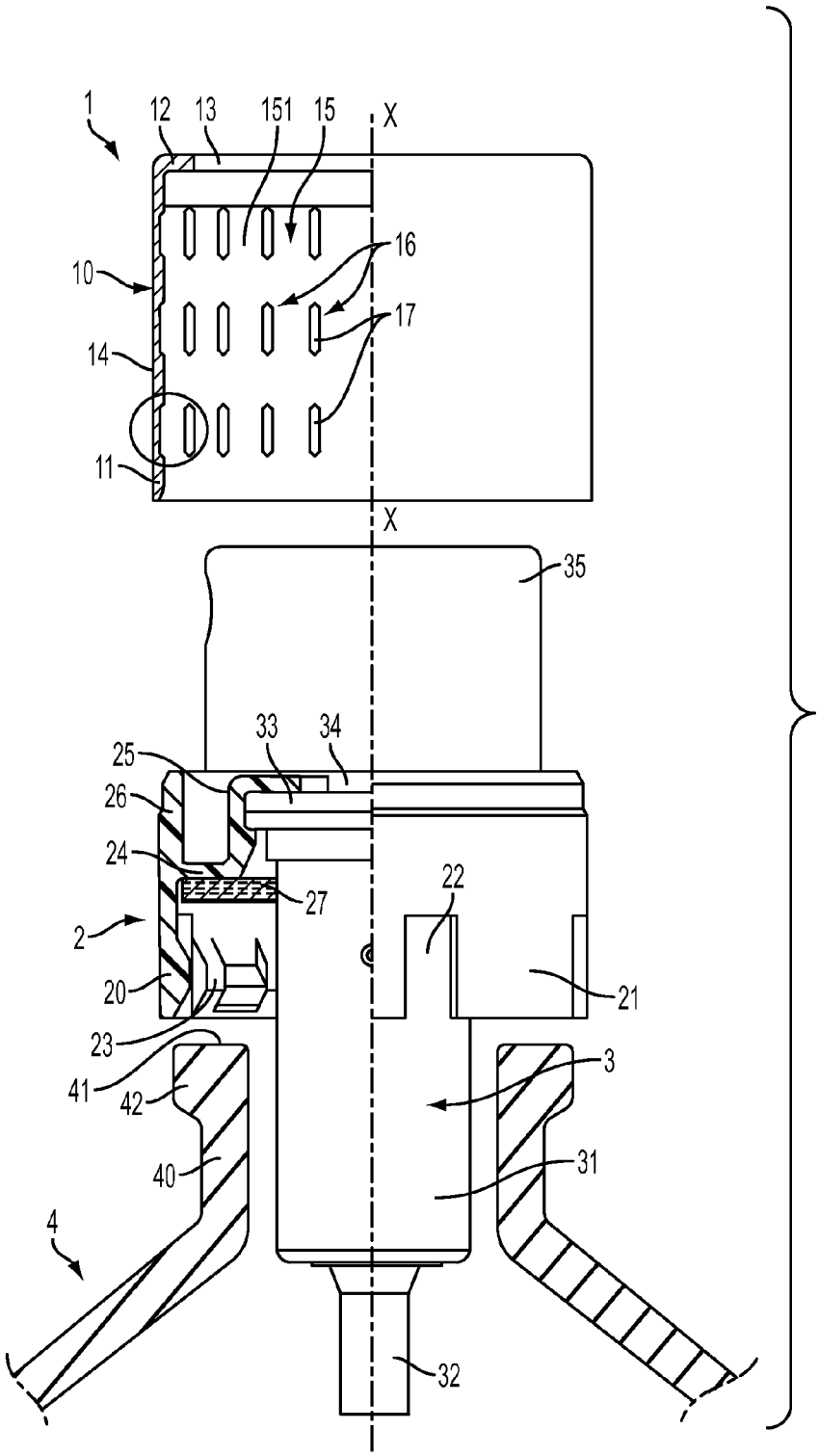
FIG. 1 is an exploded view, partially in section and partially in plan, of a fluid dispenser implementing a covering member constituting a first embodiment of the invention.

In the embodiments used to illustrate the present invention, the covering member fulfils both technical and appearance functions. The covering member constitutes a member that is visible from the outside, and that consequently imparts an attractive appearance. This is why the covering member is designated in the following description by a term that is frequently used in the fields of perfumery and cosmetics, namely a "covering hoop". The term "covering" is particularly appropriate, given that the hoop covers the fastener ring, as can be seen below.

Reference is made initially to FIGS. 1 to 4 in order to explain in detail the first embodiment of a covering hoop of the invention. The hoop is designated overall by numerical reference 1. It can be made of plastics material or of metal. It presents a general configuration that is substantially cylindrical with a hollow inside. More precisely, the hoop comprises a tube 10 that is substantially cylindrical, and that includes a bottom end 11, and a top end that extends inwards in the form of an inwardly-directed rim 12. The edge of the inwardly-directed rim 12 defines an opening 13 that leads into the tube 10. The tube 10 includes a visible outside wall 14 and an inside wall 15.

Figure 2:
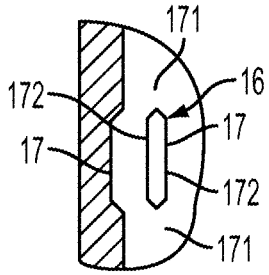
FIG. 2 is a very greatly enlarged view of a detail of FIG. 1.

In the invention, the inside wall 15 is provided with grooves 16 that are hollowed out relative to a smooth cylindrical base zone 151. The grooves are made up of finite groove segments 17 that extend vertically, i.e. parallel to the axis X of the cylinder formed by the tube 10. The inside wall 15 of the tube 10 is thus provided with twenty-four grooves 16, each formed by three groove segments that extend in the direction of the groove. The grooves 16 extend parallel to one another, and are distributed over the wall in equidistant manner. Another disposition is also possible. The number of grooves can also vary. With reference to FIG. 2, it can be seen that each groove 16 comprises three segments 17 that are separated by zones that are smooth or non-grooved. The non-grooved zones can be formed by the base zone 151. The segments 17 present an elongate configuration that lies in the same longitudinal direction as the grooves 16. Each segment thus forms two ends 171 and two long edges 172, as can be seen in FIG. 2. It is also possible to form the segments with a configuration that is less elongate, such that each segment generally forms a dot. The grooves can be likened to a discontinuous or dotted line having dots that are constituted by the groove segments.

A characteristic of this first embodiment resides in the fact that the grooves 16 are vertical, i.e. they extend parallel to the axis X of the cylinder formed by the tube 10. Advantageously, the grooves 16 do not extend as far as the bottom end 11, but start a little higher, leaving a bottom zone that does not have grooves. The same applies for the top end of the tube 10 that also does not have grooves.

The covering hoop 1 is for co-operating with a fastener ring 2 that presents a configuration that is entirely conventional for the fields of perfumery and of cosmetics. The ring can be made of plastics material. The fastener ring 2 includes a skirt 20 defining tabs 21 that are separated by vertical longitudinal slots 22. Each tab 21 internally forms catches 23 that project inwards. The tabs 21 are separated by the slots 22 in such a manner as to impart to the tabs, a capacity for deformation that is necessary in order to engage the ring on the neck. At its top end, the skirt 20 is connected to a plate 24 that extends inwards forming a snap-fastener housing 25 having a function that is explained below. In addition, the ring 2 includes a guide wall 26 that advantageously extends upwards in alignment with the skirt 20.

A dispenser system 3, specifically a pump, is engaged in the snap-fastener housing 25 of the ring 2. The pump 3 includes a body 31 defining an inlet 32 at its bottom end, and a collar 33 at its top end, which collar is engaged by snap-fastening inside the housing 25. The pump 3 also includes an actuator rod 34 that is movable downwards and upwards inside the body 3. The actuator rod 34 projects out from the body and receives an actuator head 35 that is in the form of a pusher. Thus, by pressing on the pusher 35, the actuator rod 34 is moved inside the body 31, thereby dispensing a dose of fluid. This pump is entirely conventional in the fields of pharmacy or of cosmetics.

As mentioned above, the ring 2 is for fastening the pump 3 on a receptacle that is designated by the numerical reference 4. The receptacle, that is shown only in part, includes a neck 40 that defines an opening that puts the inside of the receptacle into communication with the outside. The neck 40 defines an annular top end edge 41 and an outer peripheral shoulder 42. The fastener ring 2 co-operates with the neck by engaging the catches 23 below the shoulder 42. In order to achieve sealing, a neck gasket 27 is compressed between the top edge 41, and the plate 24 of the ring 2. To get below the shoulder 42, the catches 23 must firstly pass beyond the shoulder 42. This is possible as a result of the tabs 21 being able to deform radially outwards so as to pass over the shoulder 42. After passing over the shoulder, the catches 23 can be received, at least in part, below the shoulder 42. In entirely conventional manner, the covering hoop 1 is mounted on the fastener ring 2 in such a manner as to block the tabs 21 around the neck 40. To do this, the inside wall 15 of the covering hoop comes into clamping contact with the outside wall of the ring that is formed by the skirt 20 and by the guide wall 26. The inside diameter of the base zone is preferably slightly less than the diameter of the fastener ring.

Figure 3:
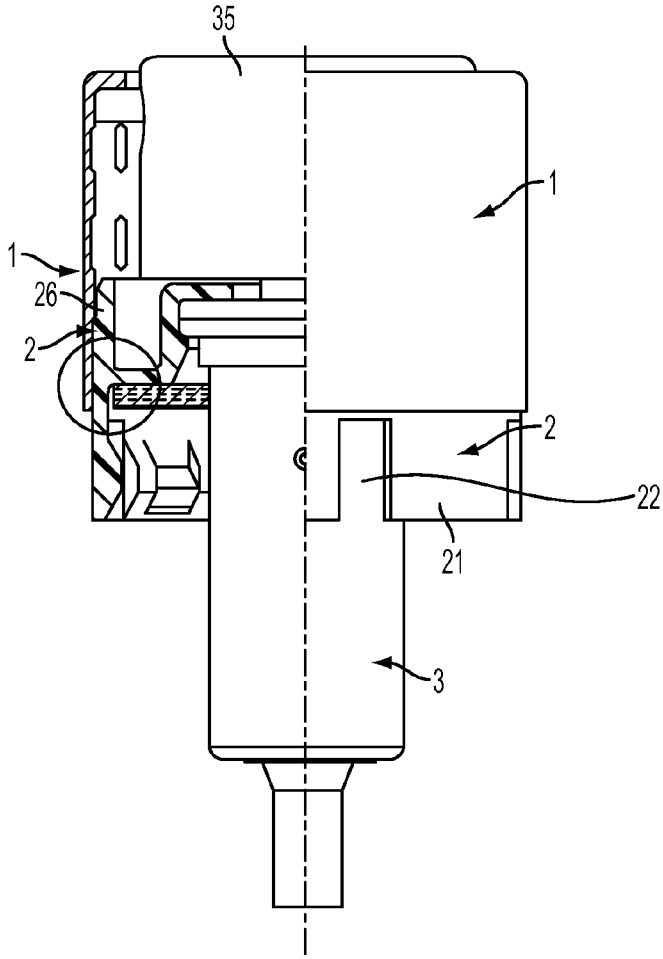
FIG. 3 is a view corresponding to FIG. 1, but in the mounted state.
Figure 4:
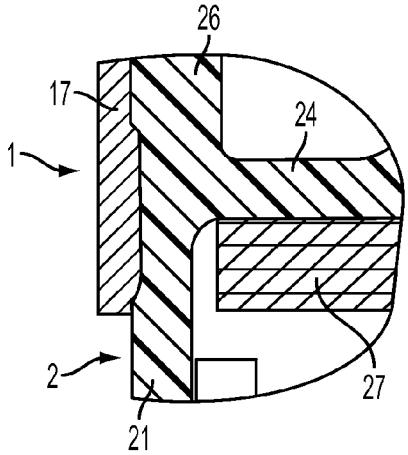
FIG. 4 is a very greatly enlarged view of a detail of FIG. 3.

With the hoop constituting the first embodiment, the plastics material constituting the ring 2 creeps into the groove segments 17. In FIG. 3, it can be seen that the covering hoop 1 is engaged, in part, on the ring 2, i.e. over the guide wall 26 only. With reference to FIG. 4 that shows a detail of FIG. 3 on a larger scale, it can be seen that the segments 17 are filled with the material constituting the ring 2. In the final position (not shown), the hoop 1 completely surrounds the ring 2, with the bottom end 11 of the hoop being situated below the bottom end of the ring, and the inwardly-directed rim bearing against the top end of the guide wall 26. In this final assembly position, the grooves 16 constituted by the segments 17 are filled by the skirt 20 and the guide wall 26. The diameter of the hoop at the bottoms of the groove segments is advantageously substantially equal to the outside diameter of the ring at the skirt.

The vertical disposition of the grooves prevents any turning of the hoop about the ring. For the most part, this prevention from turning is provided by the edges 172 of the segments. In the invention, the ends of the segments also participate in retaining the hoop on the ring, mainly with regard to withstanding traction, making it possible to prevent the hoop from being removed from the ring by pulling on said hoop. The creep qualities of plastics material have been well known for a long time. Such creep characteristics enable the plastics material constituting the ring to creep into the segments. The substantially perpendicular orientation of the ends relative to the edges thus provides good ability to withstand both turning and traction. This does not apply with continuous grooves as in the above-mentioned prior art documents.

Figure 5:
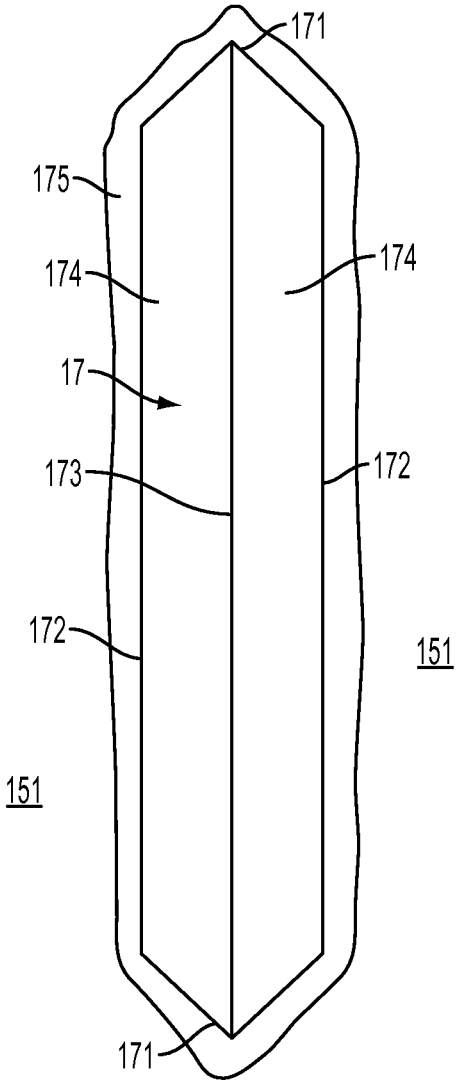
FIG. 5 is a very greatly enlarged view of a groove segment that is formed by displacing material.

Such locally-interrupted grooves can be made in various ways. For example, it is possible to form the grooves during a single manufacturing step, e.g. by molding a plastics material. It suffices to provide a mold cavity that is suitable for making separate segments. It is also possible to make such a hoop out of metal in a single manufacturing step, e.g. by molding, although this is not very practical. The hoop of the invention is advantageously made in two successive steps, namely a first step consisting in making a hoop by stamping metal in such a manner as to form the smooth inside wall, then machining the segments by removing material or displacing material so as to form discontinuous grooves. The technique of machining by displacing material is preferred, given that it generates neither metal debris nor swarf. By way of example, it is possible to use embossing or knurling techniques to machine the segments by displacing material. FIG. 5 is very greatly enlarged view of a segment that is machined by displacing material. As mentioned above, each segment 17 comprises two opposite ends 171 that are interconnected by two edges 172. Each segment is hollowed out relative to the base zone 151 defined by the inside wall 15. The segment 17 thus constitutes a hollow forming two flanks 174 that converge towards a groove bottom 173. The segment 17 thus presents a substantially triangular section. This shape enables better penetration of the material constituting the fastener ring. Given that the segment 18 is obtained by displacing material, e.g. by embossing or by knurling, the segment is bordered by lumps of displaced material. In particular, it can be seen in FIG. 5 that the entire periphery of the segment is bordered by a peripheral ridge that projects relative to the base zone 151. The ridge forms a projecting profile that further promotes the retention of the hoop on the ring. Two segments are thus identified by two lumps of displaced material and a land of the base zone 151.

Figure 6:
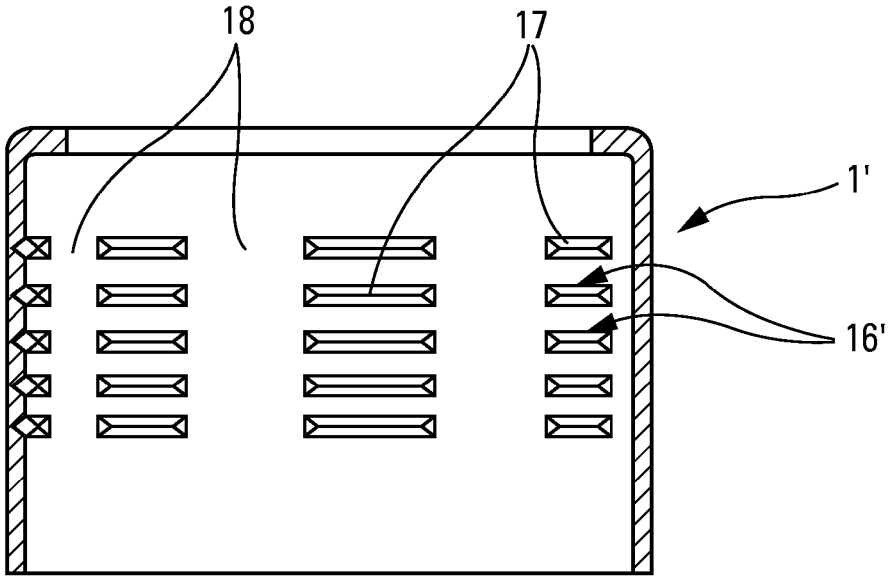
FIGS. 6 and 7 are section views of two covering members constituting two further embodiments of the invention.
Figure 7:
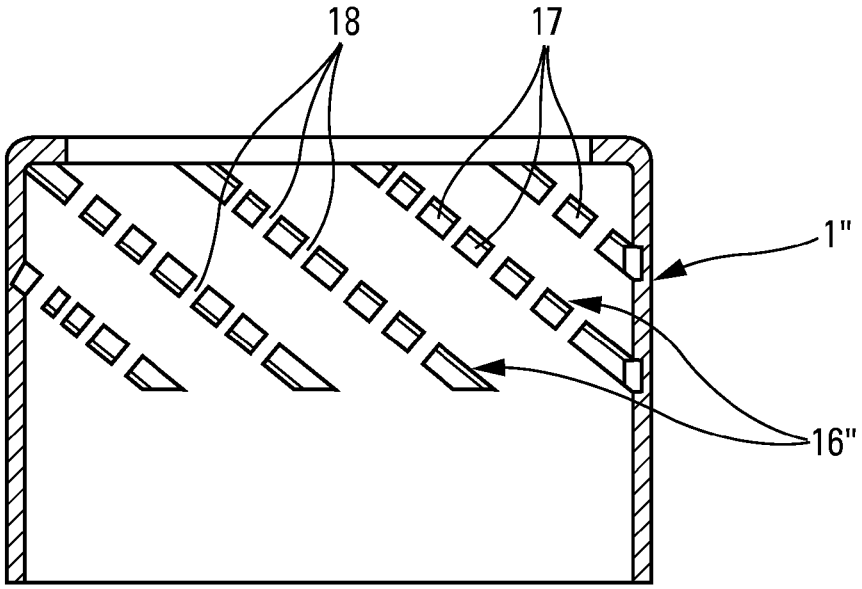

FIG. 6 shows another embodiment for a covering hoop of the invention. The covering hoop 1' includes oblique grooves 16' that extend parallel to one another. The angle of the oblique grooves 16' relative to the longitudinal axis of the hoop is about 45°. It can be seen in FIG. 7 that the grooves 16" are formed by segments 17 that are separated by the base zone 151. The segments 17 can be formed using any technique, e.g. by molding, or by removing or displacing material. As a result of the inclined orientation of the segments 17, said segments are disposed in a lozenge configuration relative to the longitudinal axis of the hoop. This lozenge disposition provides good ability to withstand both turning and traction.

A principle of the invention can be seen in the fact of forming localized, dot-shaped, or discrete segments on the inside wall of a covering hoop, or more generally on a covering member, for engaging around a fastener ring of a pump or a valve.

The invention claimed is:

1. A covering member assembly comprising: a plastic fastener ring to be secured to a receptacle;

a cylindrical covering member mounted on the fastener ring, the ring and the covering member cooperating with each other to form a fastener device for fastening a dispenser system to a neck of the receptacle, the covering member includes an outside wall and an inside wall for coming into clamping contact around the ring, the inside wall comprising:

an array of grooves including a plurality of elongate longitudinal groove segments interlaced by an array of non-groove zones, a portion of the plastic fastener ring creeping into the elongate groove segments of the inside wall of the covering member.

2. The covering member assembly according to claim 1, wherein the elongate groove segments are disposed substantially horizontally, forming interrupted annular grooves.

3. The covering member assembly according to claim 1, wherein the elongate groove segments are made by displacing metal material from the inside wall, such that each segment is bordered by lumps of displaced metal material.

4. A fluid dispenser assembly comprising the receptacle, the dispenser system, and the fastener device in combination that integrates the covering member according to claim 1.

5. The covering member assembly according to claim 1, wherein the elongate groove segments extend serially to define a discontinuous track.

6. The covering member assembly according to claim 1, wherein the at least one elongate groove is broken longitudinally by the non-groove zones.

7. The covering member assembly according to claim 1, each groove segment has two ends and two long edges, wherein the two ends of each elongate groove segment are respectively interconnected by the corresponding two long edges.

8. A covering member assembly comprising: a plastic fastener ring to be secured to a receptacle;

a cylindrical covering member mounted on the fastener ring, the ring and the covering member cooperating with each other to form a fastener device for fastening a dispenser system to a neck of the receptacle, the covering member includes an outside wall and an inside wall for coming into clamping contact around the ring, the inside wall comprising:

an array of grooves including a plurality of elongate lateral groove segments arranged in a series of rows and columns interspersed by non-groove zones, a portion of the plastic fastener ring creeping into the elongate groove segments of the inside wall of the covering member.

* * * * *